US010457432B2

(12) United States Patent
Spatafora et al.

(10) Patent No.: US 10,457,432 B2
(45) Date of Patent: Oct. 29, 2019

(54) APPARATUS FOR PRODUCING PACKAGES OF INFUSION PRODUCTS

(71) Applicant: AZIONARIA COSTRUZIONI MACCHINE AUTOMATICHE A.C.M.A. S.P.A.

(72) Inventors: Mario Spatafora, Granarolo Dell'Emilia-Bologna (IT); Daniele Coi, Bologna (IT); Giacomo Noferini, Castenaso-Bologna (IT); Stefano Nanni, Treviolo-Bergamo (IT)

( * ) Notice: Subject to any disclaimer, the term of this patent is extended or adjusted under 35 U.S.C. 154(b) by 288 days.

(21) Appl. No.: 15/506,691

(22) PCT Filed: Jul. 24, 2015

(86) PCT No.: PCT/EP2015/001545
§ 371 (c)(1),
(2) Date: Feb. 24, 2017

(87) PCT Pub. No.: WO2016/029986
PCT Pub. Date: Mar. 3, 2016

(65) Prior Publication Data

US 2017/0240305 A1 Aug. 24, 2017

(30) Foreign Application Priority Data

Aug. 28, 2014 (IT) ..... BO2014A0467

(51) Int. Cl.

| | |
|---|---|
| ***B65B 29/04*** | (2006.01) |
| ***B65B 51/00*** | (2006.01) |
| ***B65B 61/00*** | (2006.01) |
| ***B65B 61/14*** | (2006.01) |
| ***B65D 85/808*** | (2006.01) |

(52) U.S. Cl.
CPC ..... *B65B 29/04* (2013.01); *B65B 51/00* (2013.01); *B65B 61/005* (2013.01); *B65B 61/14* (2013.01); *B65D 85/808* (2013.01)

(58) Field of Classification Search
CPC ..... B65B 51/07; B65B 61/14; B65B 29/02; B65B 29/28; B65B 29/04
USPC ..... 53/134.1, 134.2, 138.5, 139.4, 284.7; 112/10, 383, 493
See application file for complete search history.

(56) References Cited

U.S. PATENT DOCUMENTS 3,566,573 A * 3/1971 Irmscher ..... B65B 29/04 426/77
3,774,369 A * 11/1973 Klar ..... B65B 29/04 426/394

(Continued)

FOREIGN PATENT DOCUMENTS

| | | |
|---|---|---|
| DE | 1229895 | 12/1966 |
| EP | 0894764 | 2/1999 |

(Continued)

*Primary Examiner* — Alexander M Valvis
*Assistant Examiner* — Himchan "Aiden" Song
(74) *Attorney, Agent, or Firm* — Themis Law

(57) ABSTRACT

An apparatus for producing packages of infusion products, such as a bag filled with a dosed quantity of a product, a tag and a length of thread attached at opposite ends to the bag and to the tag respectively, includes a forming group of the filled bag, a feeding group of the formed bag and of the tag, a cutting and feeding group of the length of thread, and a sewing head of the length of thread to the bag and to the tag.

10 Claims, 15 Drawing Sheets

(56) References Cited

U.S. PATENT DOCUMENTS

| | | | | | |
|---|---|---|---|---|---|
| 3,805,483 | A * | 4/1974 | Romagnoli | B65B 29/04 | 53/134.2 |
| 5,657,712 | A * | 8/1997 | Romagnoli | B65B 29/04 | 112/156 |
| 6,050,059 | A * | 4/2000 | Rea | B65B 11/54 | 53/134.2 |
| 6,216,620 | B1 * | 4/2001 | Shepard | A61F 13/2085 | 112/156 |
| 6,499,273 | B1 * | 12/2002 | Marzocchi | B65B 29/04 | 493/226 |
| 6,711,876 | B1 * | 3/2004 | Benedetti | B65B 29/04 | 493/375 |
| 2004/0226263 | A1 * | 11/2004 | Romagnoli | B65B 29/028 | 53/134.2 |
| 2007/0186513 | A1 * | 8/2007 | Romagnoli | B65B 9/067 | 53/449 |
| 2013/0181447 | A1 * | 7/2013 | Romagnoli | B65B 29/04 | 289/1.5 |
| 2015/0291347 | A1 * | 10/2015 | Rivola | B65B 29/02 | 426/77 |

FOREIGN PATENT DOCUMENTS

| | | | | |
|---|---|---|---|---|
| EP | 0894764 | A1 * | 2/1999 | B65B 29/04 |
| EP | 1384665 | | 1/2004 | |
| EP | 2366628 | | 9/2011 | |

* cited by examiner

APPARATUS FOR PRODUCING PACKAGES OF INFUSION PRODUCTS

TECHNICAL FIELD

The present invention relates to an apparatus for producing packages of infusion products, in particular tea and similar products.

KNOWN ART

Apparatuses for packaging infusion products, such as camomile, tea and similar herbs, are known. These products are usually contained in dosed amounts inside specific bags of material permeable to liquids, usually called "filters". In addition to filters, the packaging of these products usually comprises the application of a specific tag, normally made of paper, attached to the filter by means of a suitable length of thread, to allow the handling of the product. Finally, the packaging of infusion products envisages a protective envelope wrapped around the single filter-bag and a packet, for example made of cardboard, in which a plurality of protective envelopes containing the single filter-bags is inserted.

Automatic packaging lines are known for packaging these products, in which a plurality of operative groups is suitable for effecting the various packaging operations in a coordinated manner: feeding a dosed quantity of product on a strip made of permeable material, unwound from a respective reel, forming the single filter-bag containing the dosed amount of product, closing the filter-bag, feeding a strip of material for tags, unwound from a further respective reel, separation of the single tags from the above strip, feeding and cutting the joining thread to size, joining each tag and each bag to the respective ends of a cut length of thread, forming the single protection envelopes around the bags joined to the tag, packaging in cardboard boxes.

Patent EP 1384665, for example, describes an apparatus for producing filter-bags containing an infusion product, comprising a group for preparing and feeding the materials used for producing filter-bags, among which a strip of filter-paper, a dosing group, suitable for positioning doses of infusion product on the strip of filter-paper, a formation group, a dividing group and a cutting group. In the formation group, the strip of filter-paper is folded over itself so as to form a tube in which doses of infusion product are placed, the tube then being progressively closed by gluing the longitudinal edges. The dividing group subsequently divides the tube by means of transversal seams upstream and downstream of respective doses of infusion product, and the cutting group then separates the filter-bags thus formed.

The joining of the length of thread to the tag and filter-bag represents a crucial phase in packaging infusion products. Effecting a correct and safe joining, in fact, requires complex joining groups, whose functioning can negatively influence the overall production rate, due to the complexity of the phases to be effected.

EP 2366628, for example, describes a method and device for fixing a thread to a tag.

The application procedure of the tag to the filter is of crucial importance with respect to both the quality of the end-product and the costs of the production process.

Infusion products having staples for respectively fixing the thread to the tag and to the filter, for example, are of poor quality. Staples or other similar fixing means can in fact expose the infused product to problems of contamination, due to the risk of releasing, even in minimum quantities, substances that can be toxic or in any case harmful for the health, such as for example iron or aluminium.

In order to overcome these drawbacks, methods have been proposed for attaching the thread, which substantially envisage tying the thread to the tag and to the filter and consequently they do not imply the permanent inclusion of additional fixing means.

European patent EP 0691268, for example, describes a method for attaching a tag to a filter-bag for infusion products. In particular, the method envisages hooking the thread in an area close to a respective end through an eye of a needle and inserting the thread in a peripheral portion of the envelope and tag, so as to exceed the thickness of the same by a value sufficient for creating a loop in the thread. The method then envisages partially withdrawing and rotating the same needle around its own axis so as to widen the above loop and finally inserting the end of the thread into the loop thus widened. Pulling the thread causes the tightening of the resulting knot.

Apparatuses suitable for effecting this type of tying operation can therefore be extremely complex.

The known methods and equipment, however, are not able to satisfy the production requirements, either in terms of velocity or quality of the results obtained.

U.S. Pat. No. 6,216,620 B1 discloses a method and an apparatus for the high-speed attachment of a thread to a receiving material, such as a tea bag. In this patent, no mention is made as to a possible tag should be attached to the material.

DE 12 29 895 B discloses how, in an apparatus with two rotating drums, tags are fed to a first drum in a tag-holder and subsequently a thread coming from a bobbin is fixed by means of a stapling device to each tag. A second drum consecutively moves tea bags forward until they are in correspondence with the first drum which advances tags attached to the thread. In a subsequent station, the thread is also attached by staples to each of the tea bags and only after cutting the thread with movable shears. Consequently separate stapling of tag and tea bags onto the whole thread and only after cutting the thread forming bags equipped with a tag connected by a thread.

EP 2 366 628 A1 discloses a method for connecting a thread to a tag, in particular a thread of a tea bag. This document only discloses the assembly of the thread on a tag and does not consider how the thread is to be attached to the tea bag or has already been previously attached.

PRESENTATION OF THE INVENTION

The objective of the present invention is to solve the problems indicated above, by conceiving an apparatus that allows the packaging of infusion products to be optimally effected.

Within this objective, a further objective of the present invention is to provide an apparatus for the packaging of infusion products operating under safe and high-speed conditions.

The above objectives are achieved, according to the present invention, by an apparatus for the packaging of infusion products according to the enclosed claims.

In short, the apparatus according to the invention, suitable for obtaining infusion products of the type comprising a bag filled with a dosed quantity of product, a tag and a length of thread attached at opposite ends to the bag and tag, comprises a forming group of a filled bag, a feeding group of at least a formed bag and at least a tag, a cutting and feeding group of a length of thread and a sewing head of said length of thread to said bag and said tag.

The sewing head peripherally carries at least one movable sewing unit, brought in succession via a first operating path, in correspondence with which the unit can be moved by a first tracking motion with respect to the above cutting and feeding group, to receive the above-mentioned length of thread, and via a second operating path, in correspondence with which the sewing unit can be moved by a second tracking motion with respect to the feeding group, to sew respective ends of the length of thread received by the cutting and feeding group, in correspondence with respective portions of the above bag and above tag.

A prerogative of the invention lies in the fact that the sewing head can be rotatingly activated in a continuous movement around the respective rotation axis, to allow the sewing operations to be effected at high rates.

BRIEF DESCRIPTION OF THE DRAWINGS

The characteristics of the invention will appear more evident from the detailed description of a preferred embodiment of the apparatus for packaging infusion products according to the invention, indicatively illustrated in the enclosed drawings, in which.

EMBODIMENTS OF THE INVENTION

Figure 1:
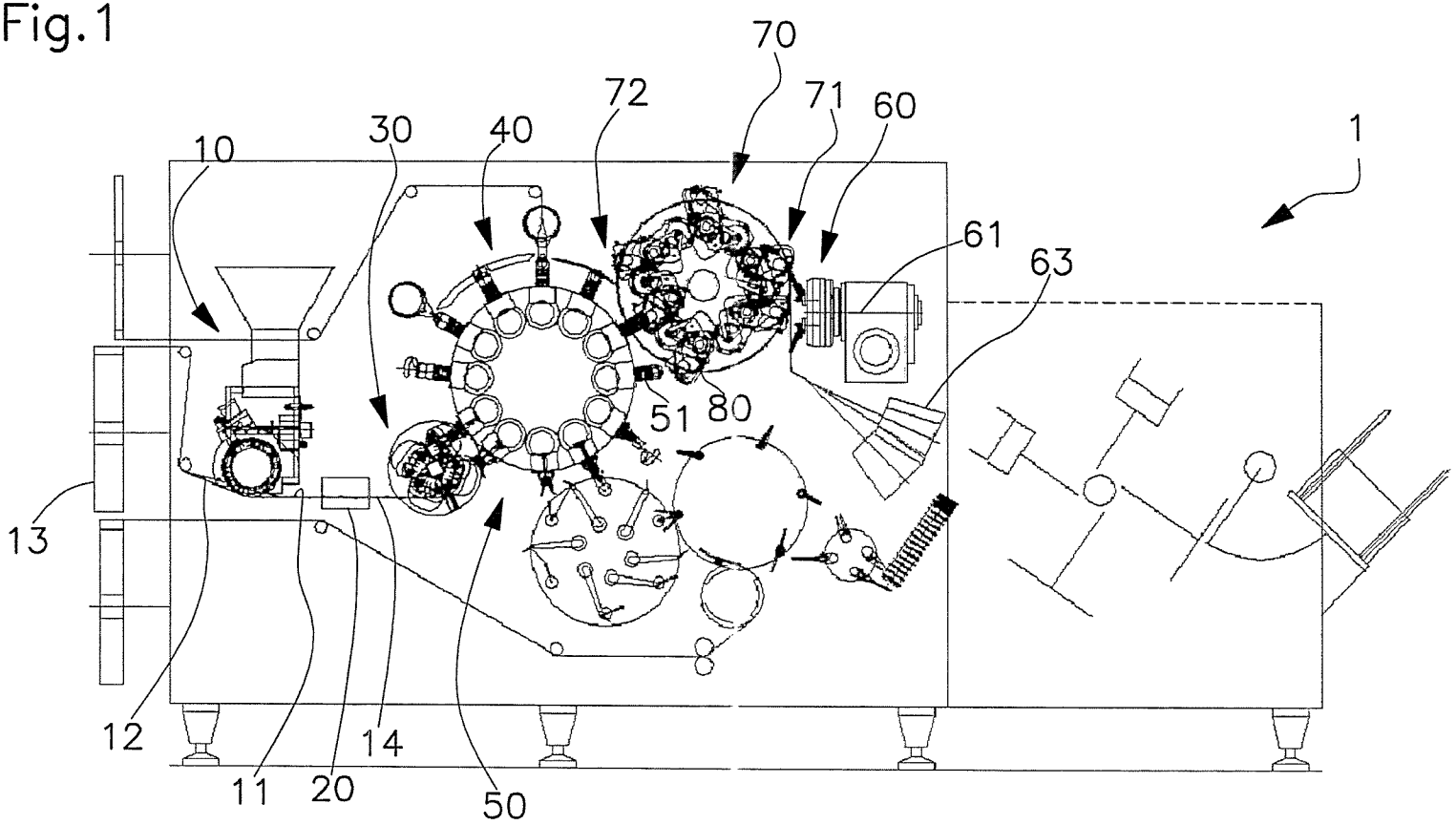
FIG. 1 shows a front schematic view of the apparatus according to the invention.

With particular reference to the above figures, the apparatus for producing packages of infusion products, such as, for example, tea, camomile, herbal teas or other infusions, is indicated as a whole with 1.

In particular, the apparatus 1 operates on a length of thread 2, a bag 3 suitably filled with a dosed quantity of product, and a tag 4, for sewing the same length of thread 2, at opposite ends, preferably of both the bag 3 and tag 4.

More specifically, the bag 3 can have, for example, as in the case illustrated, a so-called "two-lobed" conformation. In practice, each bag 3 is formed by the folding of a pair of respective containment portions, in each of which a single dose of product is inserted. The bag 3, usually made of filter paper, permeable to water or other infusion liquid, can have, for example, a bellows-like fold 3*a* at the base (see FIG. 3), whereas at the opposite closing end 3*b*, it can have one or more folded flaps to ensure the sealing of the product contained therein. The tag 4 is preferably made of paper or similar material, suitable for containing printed identifying information of the product. The length of thread 2, connecting the bag 3 and the tag 4, serves for allowing the product to be handled in the infusion phase, to avoid direct contact with the infusion liquid, which generally has a high temperature.

The apparatus 1 also comprises a dosing group 10 of the infusion product, suitable for dosing single quantities or doses 11 of product, positioning them on a strip 12 of suitable material, preferably filter paper, unwound from a respective reel 13 schematized, for the sake of simplicity, in FIG. 1. In practice, the single doses 11 are neatly arranged in succession on the strip 12, preferably fed on a substantially horizontal run.

Downstream of the dosing group 10, the apparatus 1 comprises a longitudinal sealing group 20, suitable for folding the doses 11 and reciprocally closing the longitudinal edges of the strip 12 being unwound, so as to form a tube 14 containing in its interior, the doses 11 prepared by the dosing group 10 (see FIG. 1).

Downstream of the sealing group 20, the apparatus 1 comprises a forming group 30 of the single bags 3 starting from the tube 14 previously sealed longitudinally by the sealing group 20. More specifically, if the package to be produced envisages the formation of a two-lobed bag, as previously indicated, the forming group 30 separates lengths of tube 14 each containing a pair of doses 11, and bellow-folds the above lengths separated in correspondence with a portion of base 3*a* interposed between the doses 11, so as to form the desired bag 3.

The apparatus 1 also comprises a closing station 40 of the closing end 3*b* of the bag 3, opposite the base 3*a*, in correspondence with which the folding is effected, for example, of a pair of side flaps and a third flap, overlying the two previous flaps, so as to seal the respective portions of tube 14 each containing a dose 11. Different conformations of the closing end 3*b* of the bag 3 can obviously be envisaged, in any case suitable for adequately sealing the bag 3, to avoid the undesired leakage of the product.

The apparatus 1 also comprises a feeding group 50 of single formed bags 3 and single tags 4, a cutting and feeding group 60 of single lengths of thread 2, cooperating with a sewing head 70 suitable for sewing respective ends of lengths of thread 2 in correspondence with the bags 3 and tags 4.

The closing station 40 is preferably positioned in correspondence with the feeding group 50, which, in turn, is positioned on a side of the sewing head 70. The cutting and feeding group 60 of the lengths of thread 2, on the other hand, is preferably positioned on the opposite side.

The feeding group 50, for example, as also the sewing head 70, can form respective rotating carousels, preferably in continuous movement, according to respective parallel axes, for example, horizontal. The cutting and feeding group 60 can also comprise a rotating carousel, stepped for example, preferably positioned according to an axis 61 perpendicular to the rotation axis of the sewing head 70.

The feeding carousel 50 of the bags and tags 4 peripherally carries one or more feeding units 51, each equipped with gripping means for a bag 3 and for a tag 4.

Figure 6:
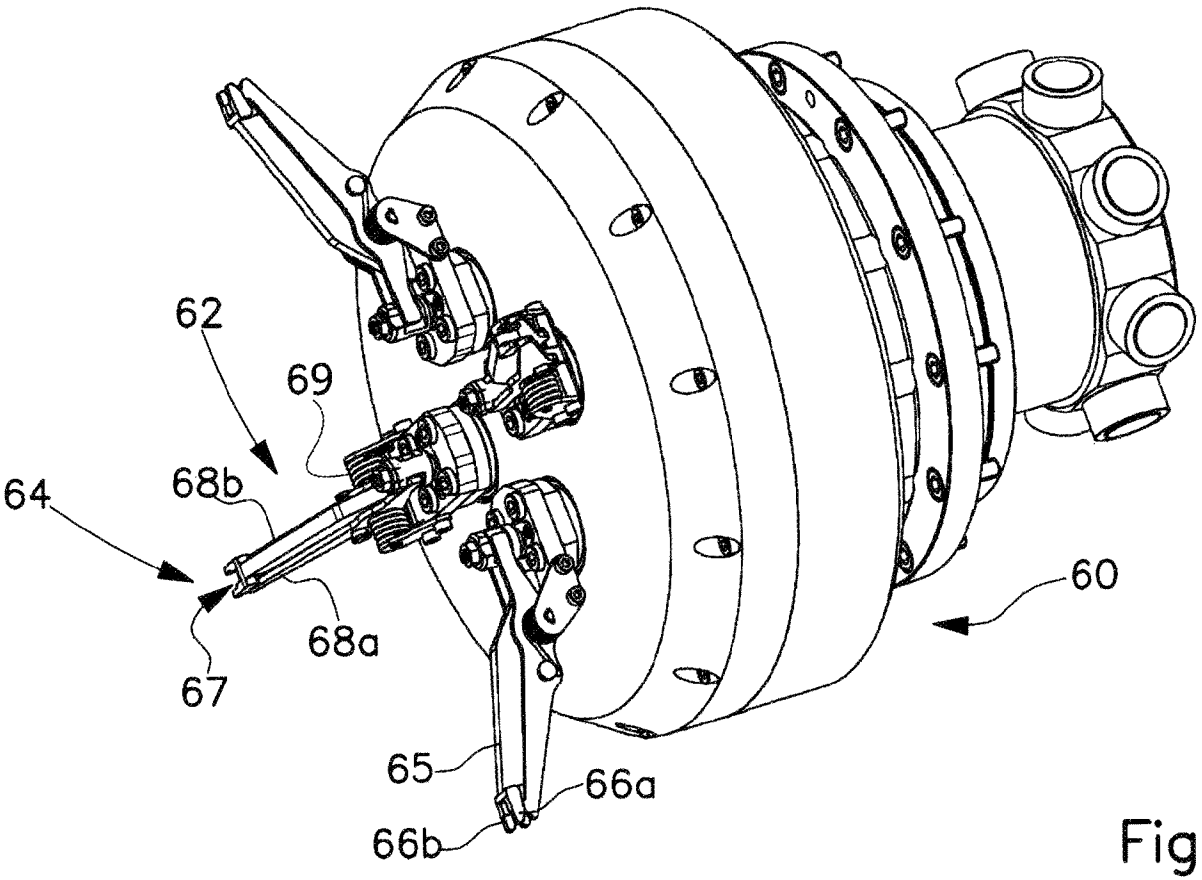
FIG. 6 shows a perspective view of a cutting and feeding group of a length of thread, suitable for cooperating with the sewing head illustrated in FIG. 2.
Figures 7A, 7B, 7C, 7D, 7E:
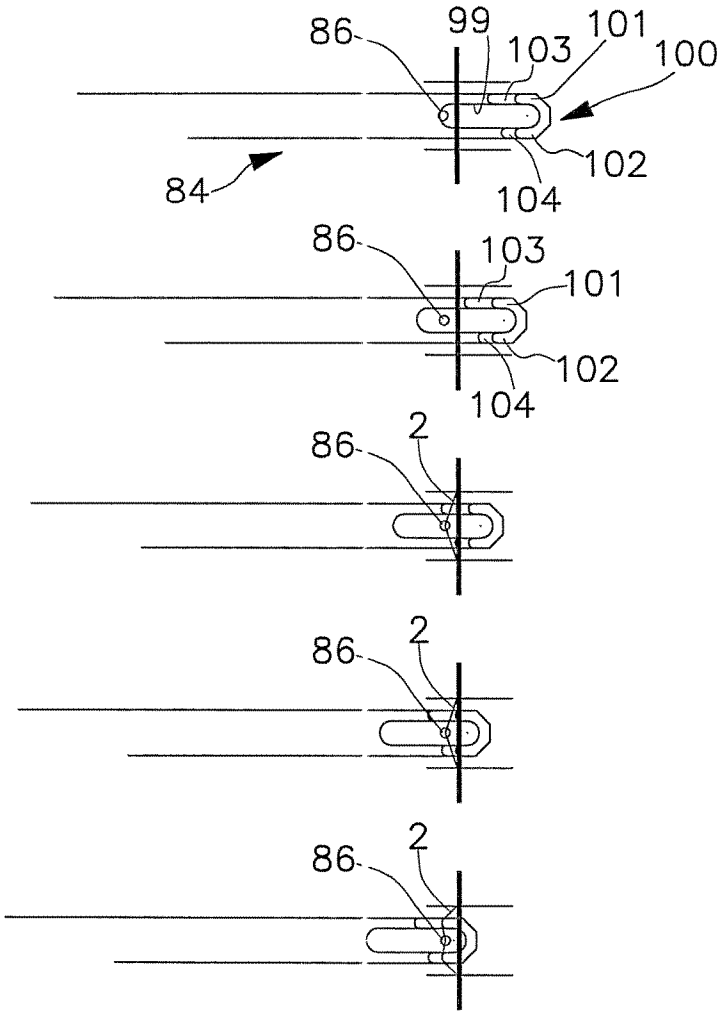
FIGS. 7*a*, 7*b*, 7*c*, 7*d*, 7*e* show a detailed schematic view of a detail of the same sewing unit, in consecutive operating phases.

The cutting and feeding group 60, represented in FIG. 6, carries a plurality of stretching elements 62 of the thread 2, suitable for unwinding and stretching from a respective reel 63 (see FIG. 1), sections of thread 2 having a suitable length for the purpose. In the case illustrated, for example, the cutting and feeding carousel 60 comprises four stretching elements 62 rotatingly assembled around respective axes parallel to the rotation axis 61 of the carousel 60. Each stretching element 62 defines an operative gripping portion 64, formed for example at the end of an arm 65, suitable for intercepting the thread 2 in correspondence with spaced portions. In particular, the operative portion 64 can define a fork having a first branch 66*a* and a second branch 66*b*, positioned at the sides of an opening 67. The first branch 66*a* and the second branch 66*b* are suitable for respectively cooperating with a first clamp 68*a* and with a second clamp 68*b*, both articulated at opposite sides of the arm 65, which can be alternatingly activated between a closed position in abutment of the respective branch 66*a*, 66*b*, and an open position, diverging from the respective branch 66*a*, 66*b*, preferably by the interpositioning of elastic contrast means 69. In practice, the fork 64, together with the first clamp 68*a* and second clamp 68*b* combine to form a dual gripper 62, suitable for intercepting the thread 2 in correspondence with respective portions, which are therefore spaced by a length of thread 2 stretched in correspondence with the opening 67. Furthermore, the rotation of the cutting and feeding group 60 around the rotation axis 61 causes the unwinding of the thread 2 from the reel of thread 63. In an appropriate phase relation with said unwinding, respective portions of thread 2 are intercepted by the dual-gripper fork 64, so as to allow the cutting means, not represented in the figures for the sake of simplicity, to effect the cutting of the thread 2 in correspondence with the opening 67 of each stretching element 62 of the thread. After the intervention of the above cutting means, the clamps 68*a*, 68*b* of the same operative portion 64, arranged in an active gripping position, can therefore withhold the ends of two respective cut lengths of thread 2, whose opposite ends are withheld by the adjacent dual-gripper elements 62, respectively.

The cutting and feeding carousel 60 guides the dual-gripper elements 62 along a stretching trajectory, preferably substantially circular, along which the thread 2 is unwound from the reel 63, and the feeding of the lengths of stretched thread 2, cut in succession in correspondence with the openings 67. The above trajectory thus leads the dual-gripper elements 62 through a transfer station 71, in correspondence with which a pair of adjacent cutting and feeding units 62 is operatively associated with a sewing unit 80, according to a first tracking motion, to transfer to the same a length of cut and stretched thread 2, as better described hereunder.

The feeding carousel 50 correspondingly cyclically guides each feeding unit 51 through a sewing station 72, in correspondence with which the gripping means of the bag 3 and tag 4 are activated by a second tracking motion, which allows a respective sewing unit 80 carried by the sewing head 70, to sew the respective ends of the length of thread 2 received by the cutting and feeding units 62, to the bag 3 and tag 4, carried by the same gripping units. 51 (see FIG. 1).

Figure 2:
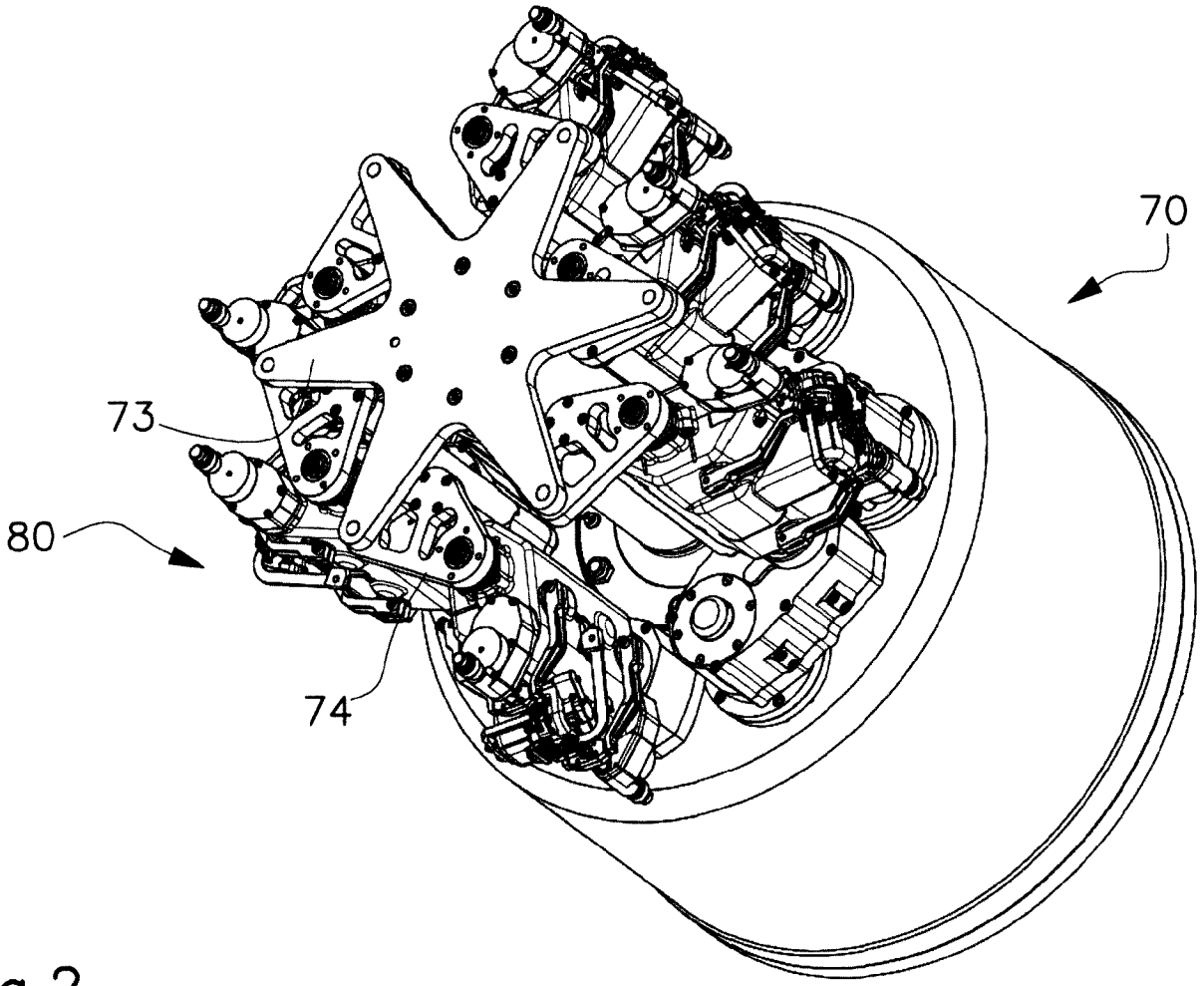
FIG. 2 shows a perspective view of a sewing head suitable for being used in the same apparatus.

The sewing head 70 peripherally carries one or more sewing units 80, for example, as in the case illustrated in FIG. 2, six sewing units 80. Different numbers of sewing units 80 moved by the sewing head 70 can obviously be envisaged.

Figure 3:
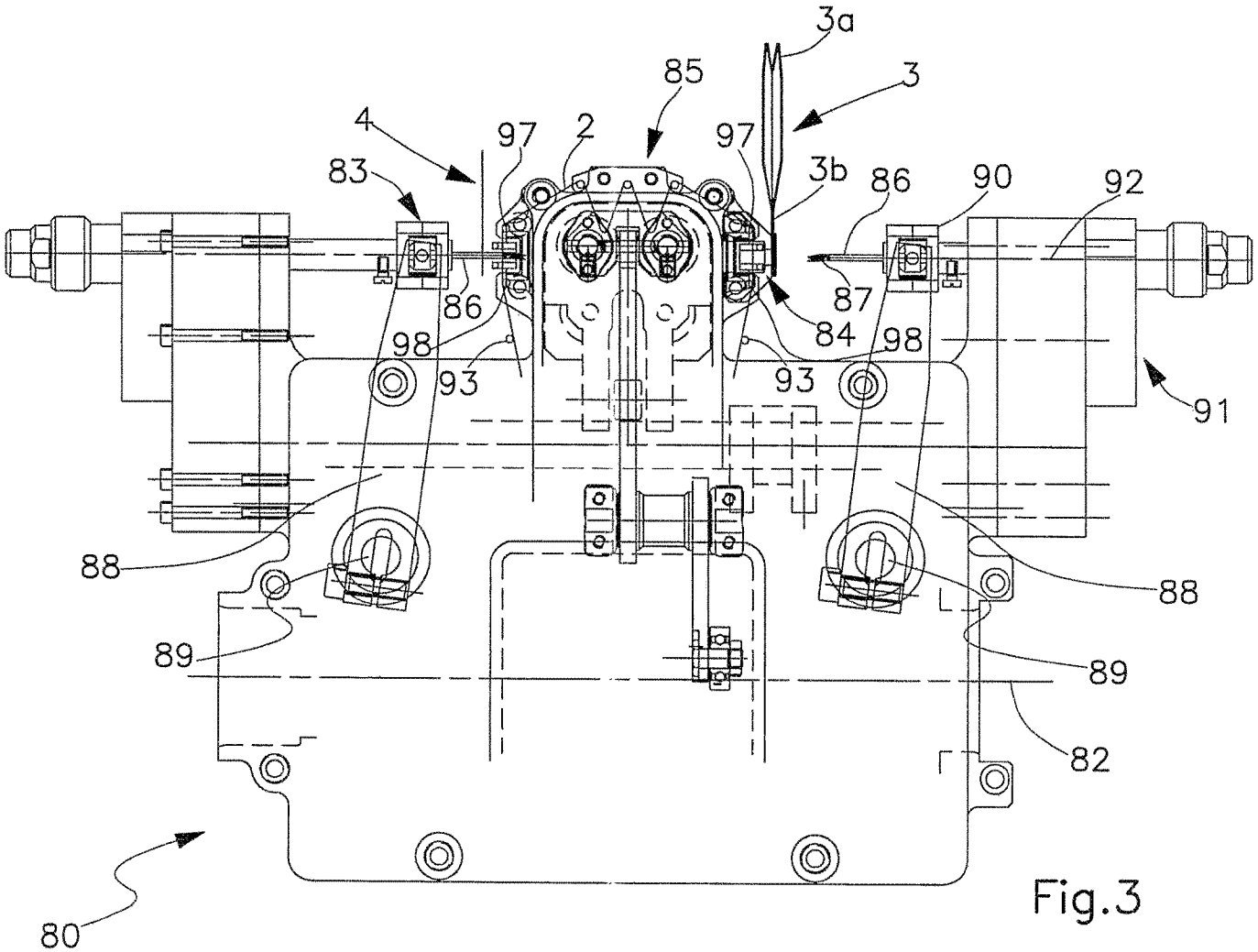
FIG. 3 shows a sectional view according to a median plane passing through a fulcrum axis of a sewing unit of the head illustrated in FIG. 2.

Each sewing unit 80 defines a body 81 articulated to the sewing head 70, according to an articulation axis 82 parallel to the rotation axis of the same sewing head 70 (see FIG. 3). The sewing head 70, for example, can carry an articulation star 73 at which each sewing unit 80 is articulated by the interpositioning of respective binary components 74, so as to allow both the above-mentioned first tracking motion, for receiving the length of thread 2 from the cutting and feeding units 62, and the above-mentioned second tracking motion, for sewing the length of thread 2 received, onto a respective bag 3 and onto a respective tag 4 carried by a respective feeding unit 51.

Each sewing unit 80 comprises a sewing device 83, an auxiliary device 84 for sewing the length of thread 2 onto the bag 3 and onto the tag 4, a tensioning control device 85 of the length of thread 2, applied to the body 81.

The sewing device 83 in turn comprises a pair of needles 86 carrying at a free operative end, an open eye 87. In practice, the eye 87 of the needle 86 has the shape of a hook, therefore open on one side, suitable for hooking a portion of thread 2. The needle 86, which has, for example, a cylindrical section, preferably has an eccentric tip (see FIG. 3) with respect to the longitudinal axis 92 of the needle 86 itself, preferably eccentric towards the side corresponding to the opening of the eye 87.

The needles 86 of the sewing device 83 are substantially coaxially arranged, with the eye 87 open, facing each other. Each needle 86 is also movably carried by a leverage 88 articulated to the body 81 in correspondence with an articulation axis 89. More specifically, each needle 86 is carried by a pair of levers 88 articulated to the body 81 on the same articulation axis 89, transversal with respect to the axis 82 on which the body 81 is pivoted to the sewing head 70.

The levers 88, which are arranged in a substantially mirror-like way, on opposite sides of the body 81, are articulated to the same central connection element 90. Each connection element 90 intercepts and acts as a support for a median portion of a respective needle 86, with which it is rotatingly associated. Furthermore, the end portion of each needle 86, opposed to the open eye 87, is engaged by an activation element 91 suitable for controlling its rotation around the longitudinal axis 92 of the same needle 86.

In short, the leverage 88 is connected to a kinematic chain situated in the sewing head 70, for example of the type with gears and/or cams, suitable for producing an alternating axial translation movement of the needle 86 away from and towards the tensioning control device 85 of the thread 2, which is positioned centrally on the sewing unit 80, according to an axial direction of the body 81.

The same needle 86 can also be activated by the actuation element 91 according to an axial rotation movement.

Each feeding unit 51 of the feeding carousel 50 is suitable for bringing a bag 3 and a tag 4 in correspondence with the respective needle 86. More specifically, during the above-mentioned second tracking motion between the sewing unit 80 and the feeding unit 50, the bag 3 is arranged with a closed portion 3*b* interposed between the needle 86 and the central control device 85 of the body 81. In particular, the median plane of the above closed end 3*b* is arranged orthogonally with respect to the axis of the needle 86. Analogously, during the above-mentioned second tracking motion, the tag 4 is arranged interposed between the needle 86 and the same control device 85, on the opposite side with respect to the bag 3.

It should be noted that during said second tracking motion, the bag 3 and the tag 4 have a relative velocity which is substantially zero with respect to the sewing unit 80, and which are then activated, in a suitable phase relationship, according to a reciprocal distancing movement, that can, according to a reference system situated on the sewing unit 80, be a lifting movement of the bag 3 and tag 4, in a direction transversal to the fulcrum axis 82, as better described hereunder.

The tensioning control device 85 of the thread 2, which is positioned centrally on the body 81, comprises withholding means 93 of the ends of the length of thread 2, cooperating with buffering means of the length of thread 2, in turn comprising a first frame 94 and a second frame 95 movable with respect to each other.

The withholding means 93 can be produced by means of a pair of gripper elements articulated to the body 81, that can be activated by a movement away from and towards, for example by rotation, of the first and second frames 94, 95, which may be configured as buffering elements for feeding the necessary portions of thread 2 to be sewn to the sewing device 83. The withholding means 93 can also be command activated alternately between an open configuration in correspondence with which the portion of thread end 2 is released, and a closed configuration, in correspondence with which said portion of thread end is intercepted and withheld by the gripper element 93. Alternatively, the withholding means 93 can be produced by means of friction elements, suitable for being suitably regulated for withholding or gradually releasing intercepted portions of thread 2.

The first frame 94 of the buffering means is preferably composed of a comb element, fixed with respect to the body 81. Such comb element can therefore comprise one or more hook-shaped teeth, suitable for engaging with portions of thread 2.

Figure 4:
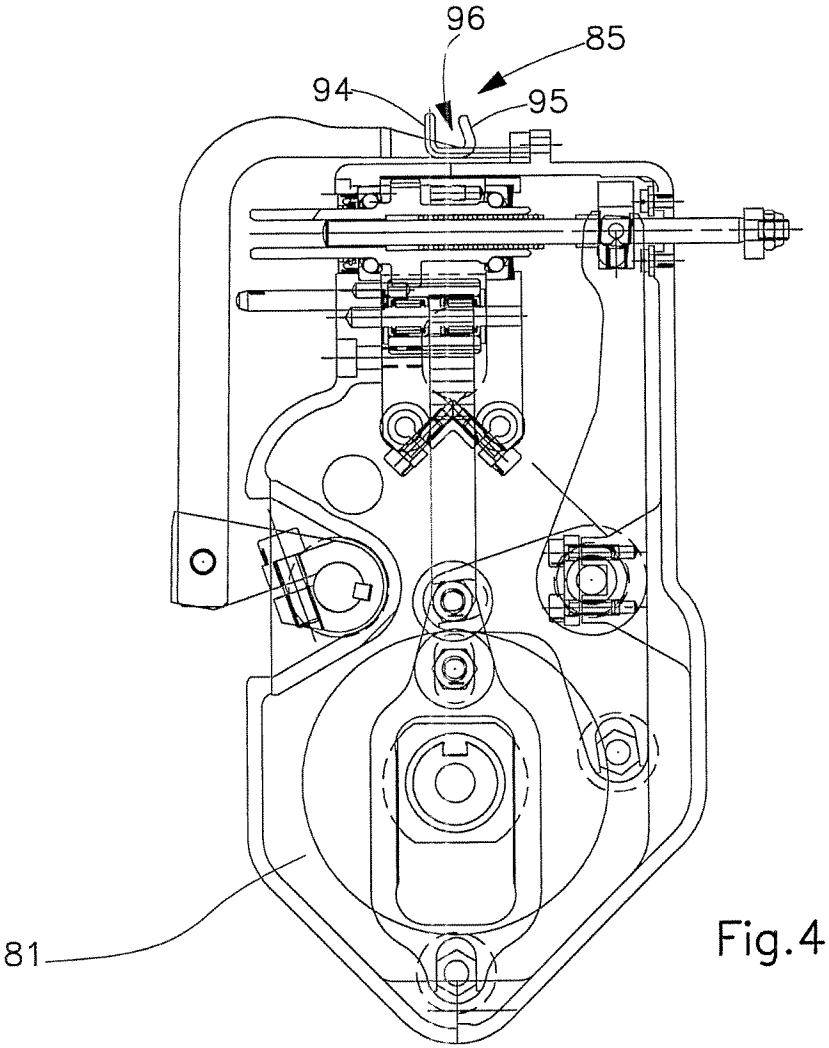
FIGS. 4 and 5 show a sectional view of a transversal plane of the same sewing unit, in different operative phases.
Figure 5:
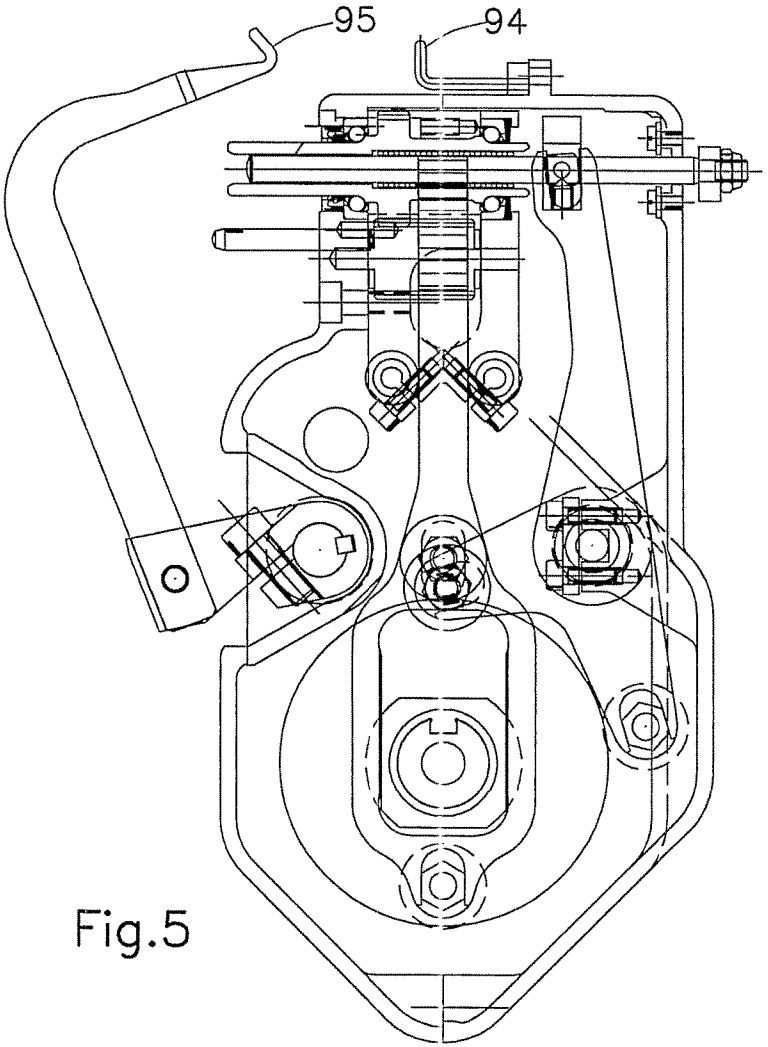

The second frame 95 can consist of an arm articulated to the body 81, forming a respective end comb. In short, the teeth of the first frame 94 and movable second frame 95 are positioned offset along a direction longitudinal to the body 81. The first and second frames 94,95 can be moved by a relative motion, alternating between an interlacing configuration for receiving the thread 2, in correspondence with which the teeth of the first frame 94 are inserted between the teeth of the second frame 95, so as to define a hooking space 96 for the thread 2, open at a side opposite to the body 81 (see FIG. 4), and a tensioning configuration, in correspondence with which the teeth of the first frame 94 deviate from the teeth of the second frame 95, so as to wind respective hooked portions of thread 2 along a zig-zag trajectory (see FIGS. 3 and 5). It should be pointed out that the above alternating movement of the first and second frames 94, 95 is coordinated, when in use, with an accompanying movement of the withholding means 93, suitable for allowing the thread 2 to be unwound along an extended trajectory or zig-zag wound around the teeth of the first frame 94 and second frame 95.

Furthermore, the tensioning control device 85 of the thread 2 can also comprise a first deviator element 97 and a second deviator element 98, for example in the form of deviator rolls, suitable for arranging a guided portion of thread 2 perpendicularly to the longitudinal axis 92 of the needle 86 and parallel to the median plane of the element to be sewn, therefore the closing portion 3*b* of the bag 3 and tag 4, respectively.

Finally, the sewing auxiliary device 84, is positioned in correspondence with the above deviator elements 97, 98, to facilitate the hooking operations of the thread 2 specifically guided between the first deviator roll 97 and the second deviator roll 98, by the open eye 87 of the needle 86, as described in more detail hereunder.

More specifically, the sewing auxiliary device 84 is preferably produced by means of an element provided with a slot 99 for the passage of the needle 86 during the perforation phase of the bag 3 and tag 4, and also for the sewing of the thread 2. The slot 99 defines an opening preferably arranged on a plane orthogonal to the longitudinal axis 92 of the needle 86. The auxiliary device 84 also defines an engagement element or tab 100 protruding from the plane of the slot 99, on the side facing the respective needle 86. The engagement tab 100, inter alia, exerts the dual function of favouring the correct hooking of the thread 2 around the eye 87 and controlling the forming phase of the loops of thread 2, for sewing the thread 2 itself to the bag 3 and tag 4.

In particular, the engagement tab 100 is suitable for cooperating with the needle 86, in a suitable phase relationship, to bring the thread 2 in engagement with the eye 87. More specifically, the engagement tab 100 is preferably fork-shaped, therefore comprising a first prong 101 and a second prong 102 positioned at the sides of the opening 99, suitable for receiving the thread 2 and controlling the interaction of the same thread 2 with the eye 87 during the operative sewing phases. The first prong 101 and the second prong 102 of the engagement tab 100 both have, in correspondence with respective front ends, respective active surfaces, for example flat or substantially flat, situated on opposite sides with respect to the opening 99 of the fork 100, and, when in use, parallel to the guided length of thread 2 and needle 86.

Each prong 101,102 of the fork 100 also defines a prolongation 103, 104 having a reduced thickness with respect to the corresponding prong, protruding from the respective active surface. More specifically, the first prong 101 has a first prolongation 103 and the second prong 102 has a second prolongation 104, laterally containing respective opposing surfaces adjacent to the above-mentioned operative surfaces, respectively.

In practice, the opposing surfaces are preferably arranged, when in use, substantially parallel to the median plane of the bag 3 and tag 4, so as to mutually intercept and deviate respective portions of thread 2.

The first prolongation 103 and the second prolongation 104 can have a differentiated longitudinal extension, so as to deviate the thread 2 in a differentiated manner. The first prolongation 103, for example, can have, as in the case illustrated, a smaller longitudinal extension with respect to the second prolongation 104. Thanks to the differentiated extension, it is possible for example, as described in more detail hereunder, that by moving the auxiliary element 100 away from the guided length of thread 2, the first prolongation 103 is disengaged, whereas the second prolongation 104 continues to intercept the same thread 2, diverting it by means of a respective opposing surface (see FIGS. 7*a* to 7*e*).

More specifically, the auxiliary element 100 is carried by a respective frame articulated to the body 81, so that it can be moved transversally with respect to the longitudinal axis 92 of the needle 86, and guided length of thread 2, and bag 3 or tag 4, respectively. In practice, the auxiliary element 100 can be moved according to a movement away from and towards the longitudinal axis 92 of the needle 86, preferably on a plane parallel to the median plane of the bag 3 and tag 4, respectively.

The functioning of the apparatus for the packaging of infusion products can be clearly understood from the above description.

The sewing of the thread 2 to the closing portion 3*b* of the bag 3, is described hereunder, considering that the same phases relate to the sewing of the thread 2 to the tag 4.

The cutting and feeding group 60 of the thread 2 unwinds the thread 2 from the reel 63 by means of its rotation movement around the rotation axis 61. In an appropriate phase relation with respect to said rotation, each dual gripper 62 intercepts a portion of thread 2 which, during its passage through the above cutting station, is cut in correspondence with the opening 67. The cutting of the thread 2 in correspondence with two adjacent grippers 62 causes the separation of a length of thread 2 stretched by the reel 63, having a suitable length.

The cut length of thread 2 is stretched, in correspondence with the transfer station 71, with the respective ends withheld by a pair of adjacent dual-grippers 62. In this condition, the cut of the length thread 2 is transferred to the sewing unit 80. For effecting this operation, the cutting and feeding unit 61 and the sewing unit 80 are brought into relative motion according to the above-mentioned first tracking motion, so as to operate, at least for an instant, in a relative zero velocity condition of the respective operating elements. In practice, the cut length of thread 2 is transferred from the grip of the dual grippers 62 to the grip of the withholding means 93. In the transfer phase, the length of thread 2 is arranged inside the hooking space 96 between the teeth of the first frame 94 and the teeth of the second frame 95.

Once the length of thread 2 has been transferred from the feeding and cutting group 60 to the sewing head 70, the sewing unit 80 is brought towards the sewing station 72. During this passage, the length of thread 2 is arranged so as to have the necessary length of thread 2 for the subsequent sewing phase, in correspondence with the specific devices for this operation. In short, the first and second frames 94,95 are suitably activated, so as to unwind the length of thread along a preferably zig-zag run, between the diverted teeth of the first frame 94 and the second frame 95 (see FIG. 3). In this preparatory phase, a portion of thread 2 is guided between the first deviator roll 97 and the second deviator roll 98, so that the same has an orientation perpendicular to the longitudinal axis 92 of each needle 86. Finally, it should be pointed out that each needle 86 is in a rest configuration, withdrawn and diverted with respect to the central tensioning control device 85 of the thread 2.

When the sewing unit 80 arrives in correspondence with the sewing station 72, the same unit 80 is activated, in relation to a respective feeding unit 51, by a second tracking motion, suitable for allowing the sewing operations of the thread 2 to the bag 3 and tag 4 to be effected.

In this phase, the feeding unit 51 brings the bag 3 to the sewing station 72, oriented with the median plane arranged parallelly to the guided length of thread 2. In particular, the closing end 3*b* of the bag 3 is interposed between the guided length of thread 2 and the tip of the needle 86. In practice, the guided length of thread 2 faces a first side of the bag 3, whereas the tip of the needle 86 is facing a second side, opposite the above first side of the same bag 3.

Figure 8:
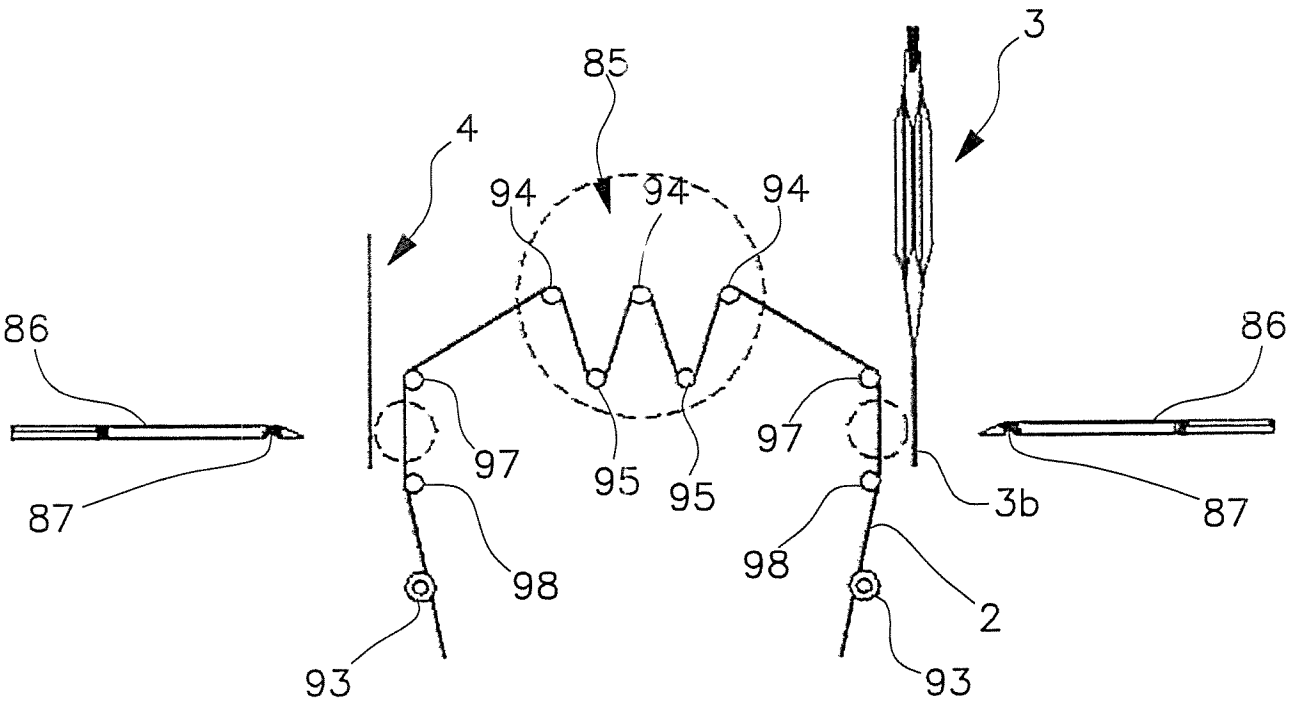
FIG. 8 shows a schematic view of a length of thread, a bag and a tag, involved in the sewing phases.

More specifically, in the second tracking motion phase, for the actual sewing, the needle 86 is still arranged in the above rest position, withdrawn and diverted with respect to the bag 3, in front of said second side. The needle 86 is also oriented with its longitudinal axis 92 arranged orthogonally with respect to the median plane of the bag 3, close to the closing edge 3*b*, with the tip facing the same edge 5. The longitudinal axis 92 of the needle 86 is also in an intermediate position between the deviator rolls 97, 98 of the tensioning control device 85 of the thread 2 (see FIG. 8).

Figure 9:
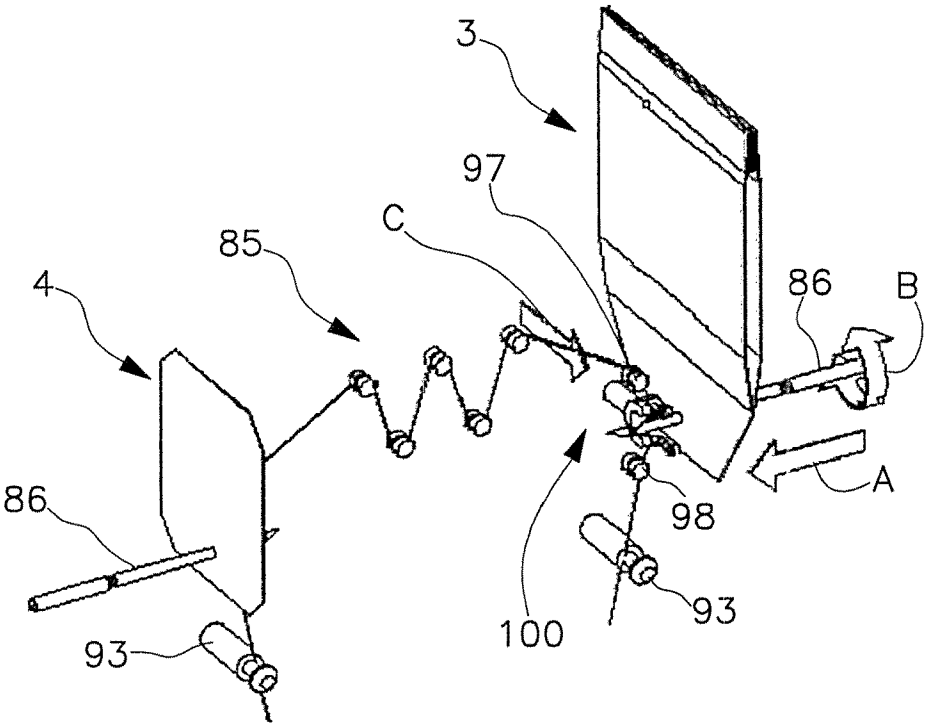

The leverages 88 are then activated so as to produce a relative axial approach movement between the needle 86 and edge 3*b* of the bag 3, indicated in FIG. 9 with the arrow A. Due to this relative approach movement, in practice, the advance run of the needle 86, or in any case, reciprocal approach, the tip of the needle 86 perforates the closing edge 3*b* of the bag 3, forming a hole 105 and then continuing until the eye 87 is brought beyond the median plane of the bag 3 itself and beyond the guided length of thread 2.

In the passage in which the tip of the needle 86 goes beyond the bag 3, the eye 87 is preferably oriented on the opposite side with respect to the guided length of thread 2. In practice, in this passage, the open eye 87 is not "facing" the guided length of thread 2 and consequently there is no risk of it interfering with the thread 2. In other words, in this perforation and advance phase beyond the bag 3, there is no risk of the accidental hooking of the thread 2.

Figure 10:
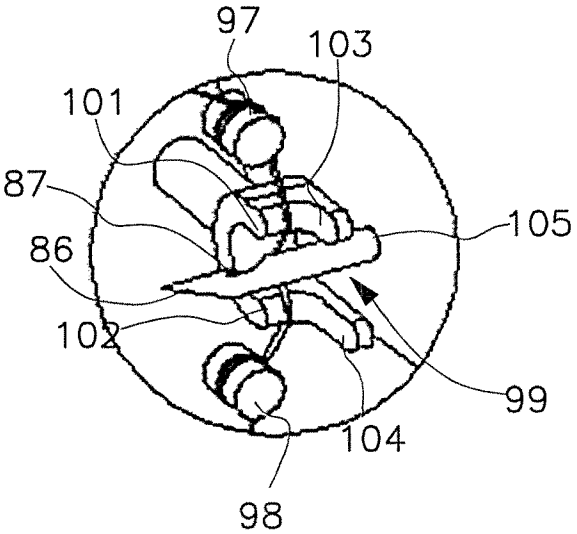
FIGS. 9 to 22 show a perspective view and a detailed sectional or perspective view, respectively, of the elements illustrated in FIG. 8, in consecutive operating sewing phases.

In a suitable phase relation with the above advance action, preferably at the end of the same phase, the needle 86 is thus activated by the activation element 91 in axial rotation, until the open eye 87 is facing the thread 2 (see FIGS. 9 and 10). The angular amplitude of this rotation, indicated in FIG. 9 with the arrow B, can range, for example, from 90° to 180°. In the case illustrated, the rotation of the needle 86 in this phase is equal to about 90°.

It should also be pointed out that in the rotation phase of the needle 86, the engagement element 100 is activated in an approach movement towards the closing edge 3*b*, for example a transversal translation movement indicated in FIG. 9 by the arrow C and illustrated in succession in FIGS. 7*a* to 7*e*, arranged with the opening substantially centered in correspondence with the perforation area, and therefore centered with respect to the needle 86. Following this approach movement, the first prong 101 and the second prong 102 of the same engagement element 100 intercept respective portions of the guided length of thread 2, thus guiding the thread 2 interposed inside the eye 87 (see in particular FIG. 7*e*). The engagement element 100 thus engages the thread 2 withheld by the first deviator roll 97 and by the second deviator roll 98 (see in particular FIG. 10).

Figure 12:
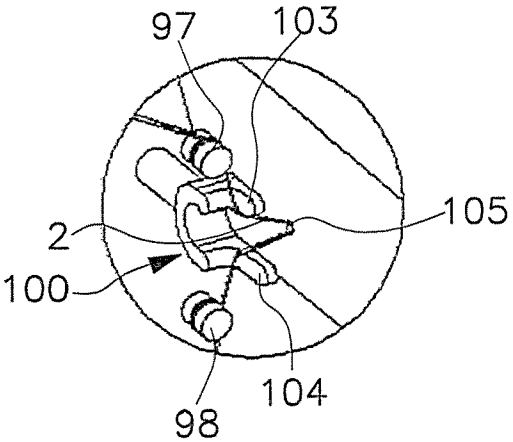
Figure 11:
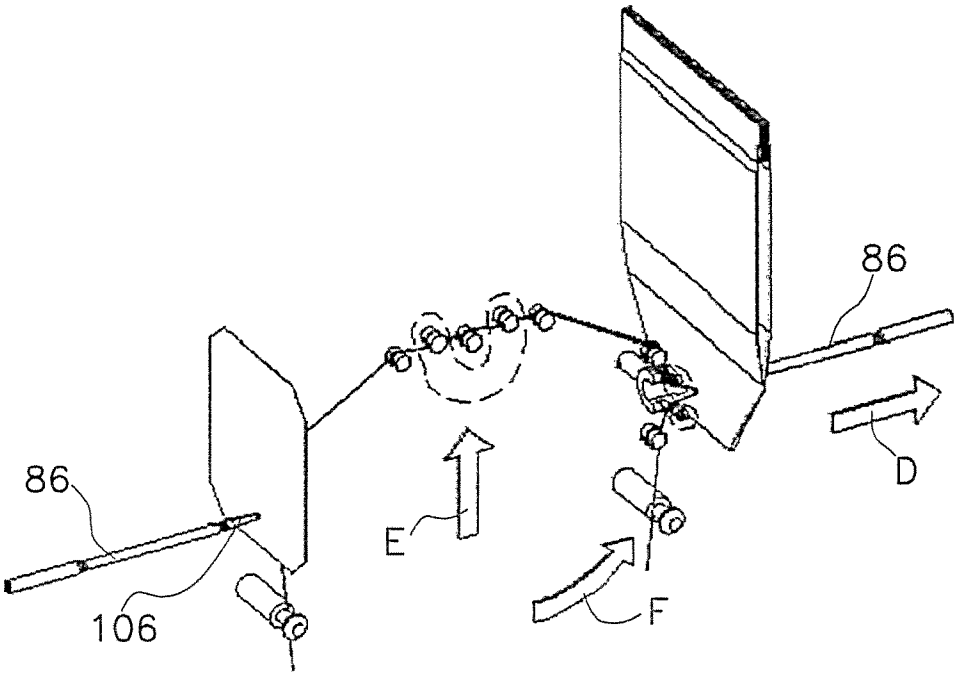

A relative axial withdrawal movement is then activated by the leverages 88, between the needle 86 and closing edge 3*b* of the bag 3, returning through the hole 105. Said withdrawal movement is indicated in FIG. 11 with the arrow D. Following this relative withdrawal movement, the thread 2 is hooked by the eye 87 and thus entrained through the hole 105 situated on the closing edge 3*b*. The entrainment of the thread 2 by the eye 87 and the passage through the hole 105 thus forms a first loop 106 in the thread 2 (see FIG. 11, in which the same loop 106 can be seen in correspondence with the tag 4). In this phase, the first loop 106 formed by the thread 2 is on one side of the bag 3 (not visible in FIG. 11) withheld in engagement by the eye 87, whereas on the opposite side, the thread 2 diverges, as it is engaged by the first prolongation 103 and by the second prolongation 104 of the engagement element 100 in correspondence with the respective above-mentioned opposing surfaces (see FIG. 12). In this phase, therefore, the engagement element 100 withholds the thread 2, controlling the divergence of the respective lengths leaving the hole 105, to avoid an undesired widening of the same hole 105, which can jeopardize the integrity of the bag 3 itself.

It should be noted that, in order to allow the formation of the first loop 106, i.e. for feeding the extension of thread 2 necessary for this purpose and keeping the tensioning of the same thread 2 constant, the first and second frames 94, 95 of the control device 85 are activated in suitable cooperation with the withholding means 93. In practice, the first and second frames 94, 95 are activated according to a relative combined movement indicated by the arrow E in FIG. 11 so as to suitably stretch the thread 2, simultaneously with a cooperating movement of the withholding means 93, for example according to an angular run indicated by the arrow F in the same figure.

Figures 13, 14:
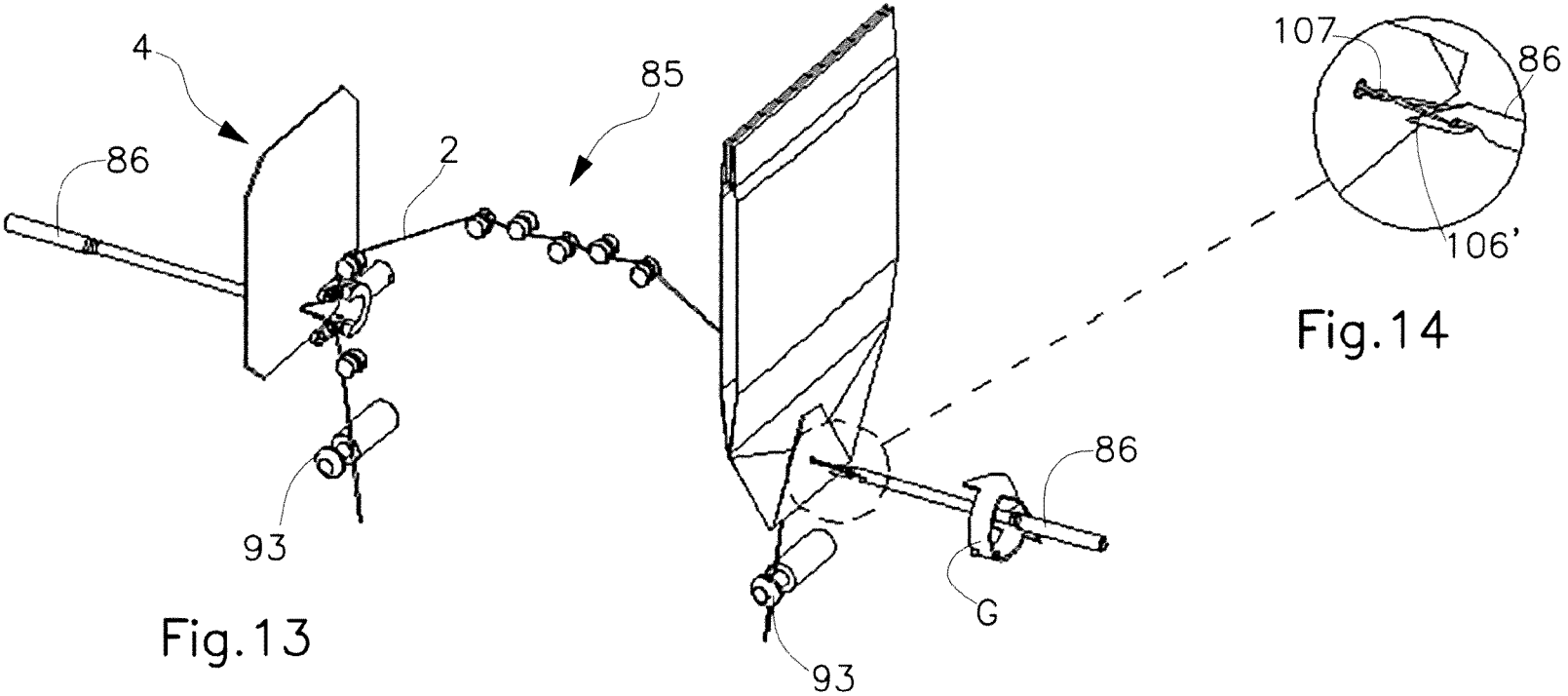

Once the first loop 106 withheld by the eye 87 has been formed (see FIG. 11), the needle 86 is axially rotated again by the activation element 91, as indicated by the arrow G of FIG. 13. The above axial rotation, which preferably has an amplitude ranging from 270° to 450°, produces a corresponding torsion of the first loop 106. The first resulting twisted loop 106' derives, in practice, from the formation of one or more overlaps or intersections 107 of the thread 2 at the base of the first original loop 106. Said intersections 107 create, in the subsequent knotting of the thread 2 at the closing edge 3*b*, a sufficient tightening friction, so as to reduce the risk of accidental unthreading (see FIG. 14).

In the subsequent phase, the second tracking motion between the feeding unit 51 and the sewing unit 80 produces a relative withdrawal movement between the needle 86 and the engagement element 100 on the one hand, and the bag 3 on the other, so that the edge 3*b* of the bag 3 is distant from alignment between the needle 86 and the engagement element 100. In practice, the bag 3 is raised with respect to the body 81, according to a translation movement indicated in FIG. 15 by the arrow H, perpendicular to the longitudinal axis 92 of the needle 86, which is a withdrawal movement with respect to the above operative elements. In addition to said relative withdrawal movement, the needle 86 inserted in the first loop 106 itself is activated so as to stretch the first twisted loop 106' beyond the closing edge 3*b* of the envelope 3, in an opposite direction to the withdrawal movement of the above-mentioned bag 3. The first twisted loop 106' is therefore rotated around the hole 105 towards the margin of the closing edge 3*b*, alongside the median plane of the edge itself, whereas the tip of the needle 86, around which the first twisted loop 106' is wound, is positioned outside the bag 3, preferably below it.

Figure 15:
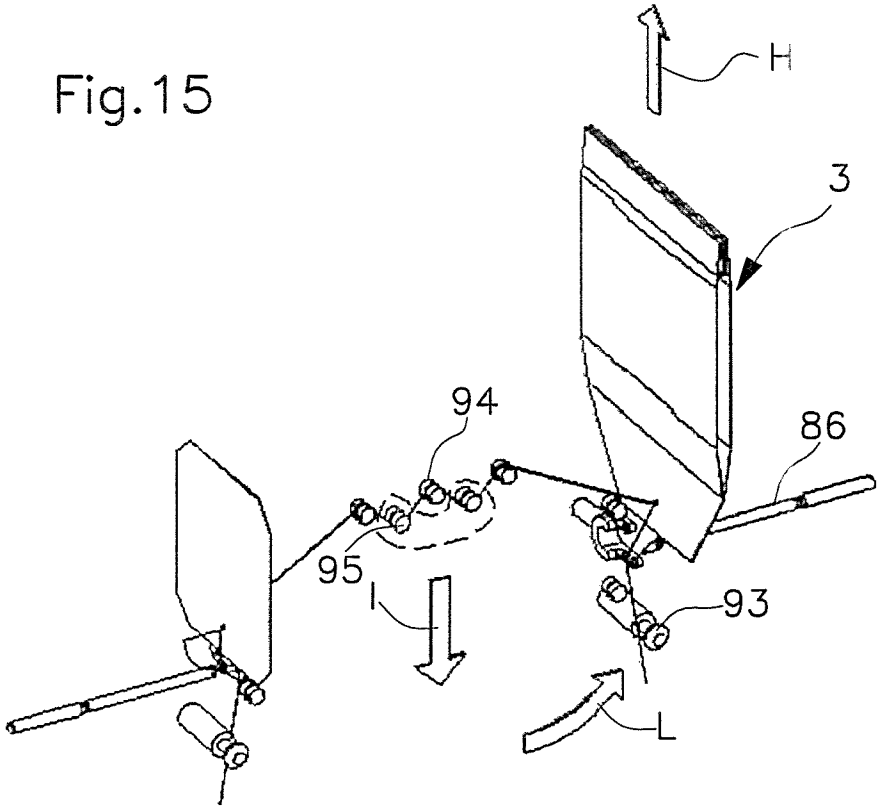

Furthermore, during the withdrawal movement of the bag 3 from the needle 86, the teeth of the first and second frames 94, 95 which are engaging the thread 2, cooperate with the withholding means 93 for maintaining the correct tensioning of the thread 2. As illustrated in FIG. 15, for example, the teeth of the first frame 94 and the second frame 95 reciprocally move towards each other in a movement coordinated with that of the withholding means 93, according to a translation indicated by the arrow I, whereas the withholding means 93 are rotated according to the rotation movement indicated by the arrow L, to stretch the thread 2 in a controlled way.

In a suitable phase relation with the withdrawal movement of the bag 3, the first deviator roll 97 and the second deviator roll 98 release the thread 2, so as to follow the motion of the buffering area and withholding means 93.

Figure 16:
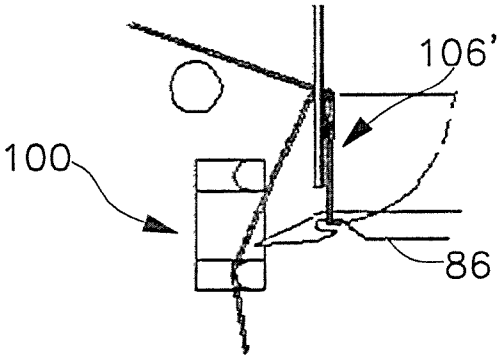

The engagement element 100, moreover, is moved, preferably backward, transversally to the guided length of thread 2, so as to partially disengage the thread 2. In practice, the retraction movement causes the disengagement of the guided length from the first prolongation 103 due to the reduced longitudinal extension of the latter, with respect to the longitudinal extension of the second prolongation 104 (see FIGS. 15 and 16).

Figure 17:
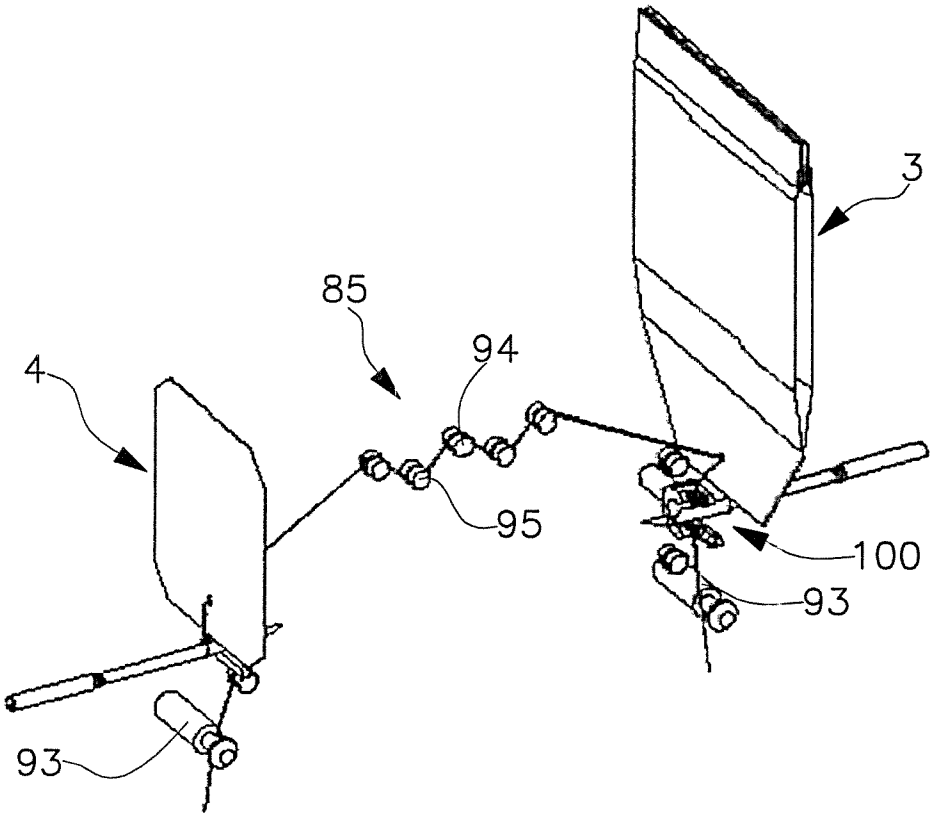
Figure 20:
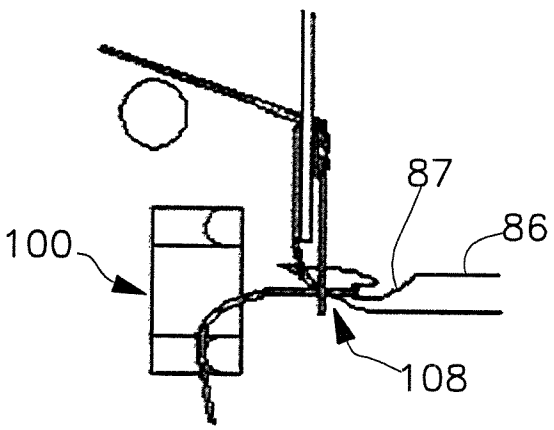
Figure 19:
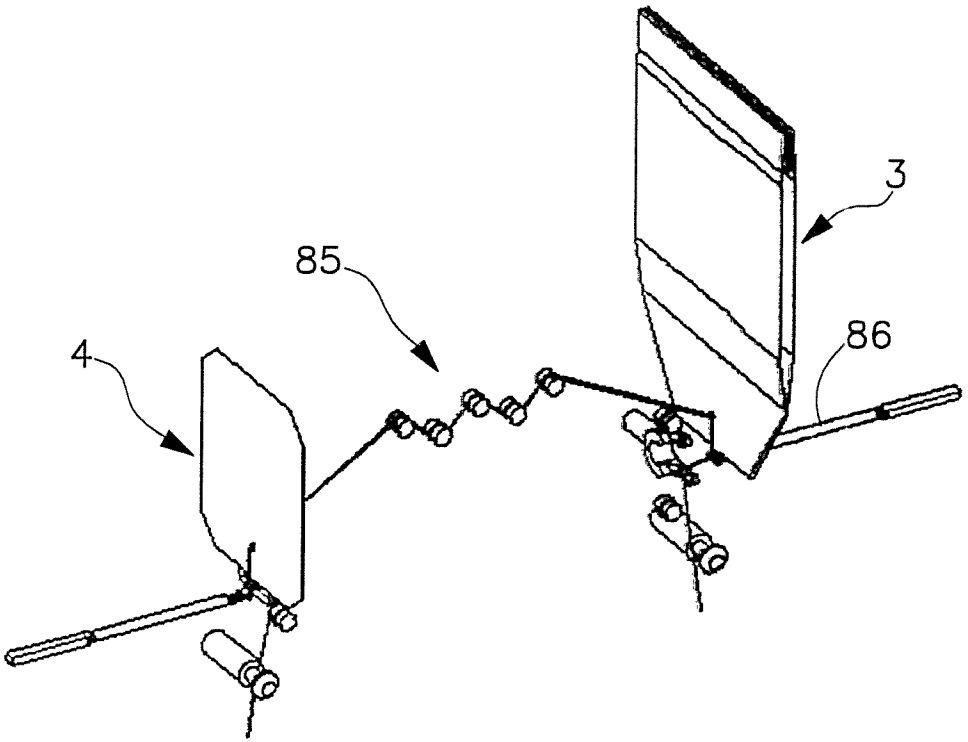

The needle 86 then effects another advance movement along its axis 92, produced by a corresponding actuation of leverages 88, passing beyond the closing edge 3*b* of the bag 3. Due to this advancement, the eye 87 of the needle 86 moves beyond the guided length of thread 2 (see FIGS. 17 and 18). As for the previous advance movement, also in this case, the eye 87 is opposed to the thread 2, to avoid accidental engagement.

Figure 18:
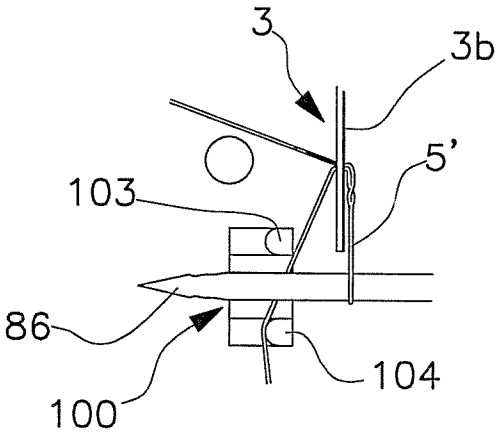

More specifically, in this phase, the guided length of thread 2 is released from engagement around the first deviator roll 97 and second deviator roll 98, whereas it is withheld in correspondence with the opening 99 by the second prolongation 104 (see FIG. 18).

Figure 22:
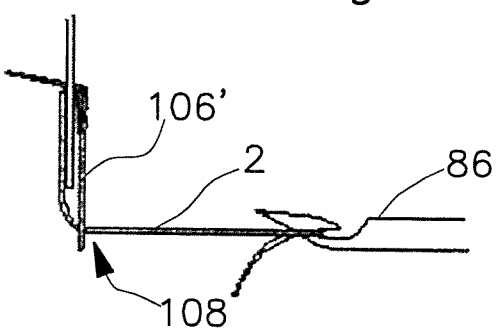

The eye 87 is then rotated on the command of the activation element 91 so as to be facing the thread 2, whereas the engagement element 100 is brought back transversally close to the thread 2, to press the same thread 2 inside the open eye 87. The needle 86 is axially withdrawn and as a result of this movement, the thread 2 is engaged by the eye 87. In the same phase, the needle 86 therefore carries the thread 2 wound in the first twisted loop 106', whereas, in correspondence with the eye 87, it carries a portion of the guided length of thread 2 engaged therewith, close to the end of the thread 2 (see FIG. 22).

Figure 21:
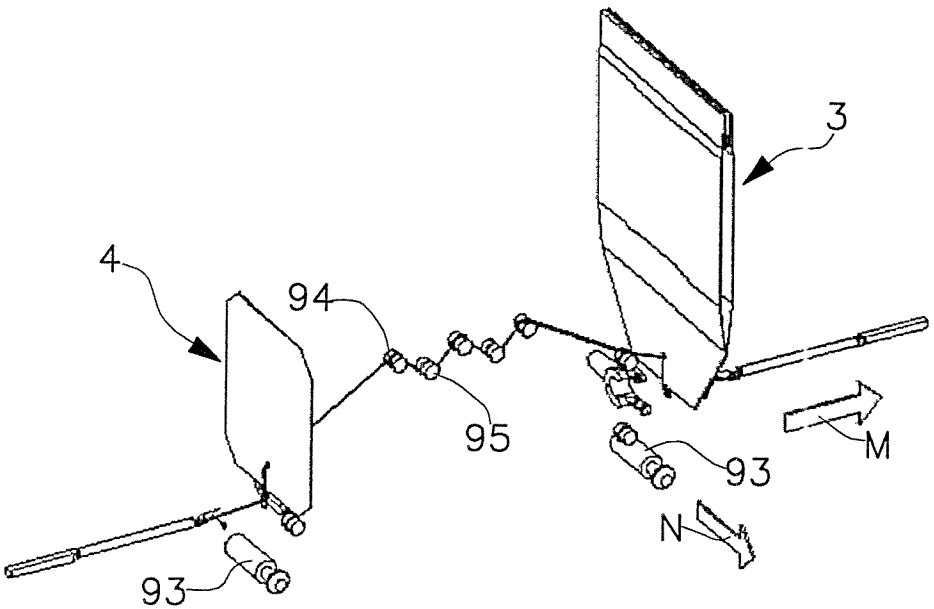

Once the thread 2 has been engaged, the needle 86 is withdrawn in an axial direction, as indicated by the arrow M in FIG. 21.

During this return passage in an axial direction, the needle 86 hooks the thread 2, forms a second loop 108 and forces the latter inside the first twisted loop 106'. During this insertion, the needle 86 keeps the eye 87 facing the closing edge 3*b* of the bag 3 to avoid accidental engagement of the first twisted loop 106'. The tauter the first twisted loop 106', the safer this passage will be, compatibly with the resistance of the edge of the hole 105 formed on the paper of the bag 3.

Once the second loop 108 has been inserted inside the first twisted loop 106', the withholding means 93 release the end of the thread 2 following a release direction indicated by the arrow N in FIG. 21, thus allowing the thread 2 hooked by the eye 87 to run through it. The eye 87 therefore leads the end portion of thread 2 through the first twisted loop 106' wound around the needle 86, thus effecting the sewing or tying of the thread 2 to the bag 3. At the end of this withdrawal run, the end portion of thread 2 is released by the eye 87 (see FIG. 22).

The packaging apparatus, as also the sewing unit described for illustrative purposes, can undergo numerous modifications and variants according to the various requirements.

In the practical embodiment of the invention, the materials used, as also the form and dimensions, can vary according to requirements.

When the technical features in each claim are followed by reference signs, said reference signs have been included for the sole purpose of providing a better understanding of the claims and consequently they have no limiting value with respect to the purpose of each element identified for exemplifying purposes by said reference signs.

The invention claimed is:

1. An apparatus for producing packages of infusion products, said packages comprising a bag (3) filled with a dosed quantity of a product, a tag (4), and a length of thread (2) attached at opposite ends to said bag (3) and said tag (4) respectively, said apparatus comprising:

a forming group (30,40) of said filled bag (3);

a feeding group (50) that feeds said filled bag after forming;

a cutting and feeding group (60) of said length of thread (2); and a sewing head (70) of said length of thread (2) to said filled bag (3), wherein said feeding group (50), said cutting and feeding group (60), and said sewing head (70) are capable of rotating around respective rotation axes, wherein said feeding group (50) of said filled bag also feeds said tag (4), and said sewing head (70) sews said length of thread (2) also to said tag (4), and wherein said sewing head (70) peripherally carries one or more movable sewing units (80), said one or more sewing units (80) being caused, in succession, to move and interact with said cutting and feeding unit via a first tracking motion of said cutting and feeding unit (60), to receive said length of thread via a second tracking motion of said feeding group (50) of said filled bag and said tag (4), and to sew ends of said length of thread (2) received by said cutting and feeding (60) group, to said bag (3) and to said tag (4) carried in a continuous movement by said feeding group (50).

2. The apparatus according to claim 1, wherein said feeding group (50) and said sewing head (70) are activated in a continuous rotational movement.

3. The apparatus according to claim 2, wherein said cutting and feeding (60) group is activated in a stepped rotational movement.

4. The apparatus according to claim 1, wherein said sewing head (50) peripherally carries the one or more sewing units (80), each of the one or more sewing units (80) forming a body (81) articulated to said sewing head (50) according to an articulation axis (82) parallel to the rotation axis of the same sewing head (70), to effect said first tracking motion and said second tracking motion.

5. The apparatus according to claim 4, wherein each of the one or more sewing units (80) comprises a sewing device (83), an auxiliary device (84) for the sewing of the length of thread (2) onto said bag (3) and onto said tag (4), and a tensioning control device (85) of the length of thread (2), applied to said body (81).

6. The apparatus according to claim 5, wherein said sewing device (84) comprises a pair of coaxial needles (86), each needle (86) being movably carried by a respective leverage (88) articulated to said body (81) to produce an alternating axial translation motion of said needle (86), away from and towards said tensioning control device (85) of the thread (2), arranged centrally on each of said one or more sewing units (80), according an axial direction of the body (81), and activated by an activation element (91) suitable for driving an axial rotation of the needle (86).

7. The apparatus according to claim 6, wherein each needle has an open end eye (87) for hooking a length of said thread (2).

8. The apparatus according to claim 5, wherein said tensioning control device (85) of the thread (2), comprises a withholding system (93) of the ends of the length of thread (2), cooperating with a buffering system of the length of thread (2), in turn comprising a first frame (94) and a second frame (95) movable with respect each other for feeding, to said sewing device (83), a required length of thread (2) to be sewn.

9. The apparatus according to claim 7, wherein said auxiliary device (84) defines an engagement element or tab (100) protruding from a side facing said respective needle (86), in order to favor a correct hooking of said thread (2) around the open end eye (87) and control a forming step of loops of said thread (2), for sewing the thread (2) to said bag (3) and to said tag (4).

10. The apparatus according to claim 1, wherein said cutting and feeding group (60) has a plurality of stretching elements (62) of the thread (2), with a dual gripper, cooperating in pairs for unwinding and stretching lengths of thread (2) having a suitable length for said sewing, each stretching element (62) comprising a first branch (66*a*) and a second branch (66*b*) spaced apart at sides of a respective opening (67) in correspondence with which a cutter cuts an end of the length of thread (2) withheld by said first branch (66*a*) and said second branch (66*b*).

* * * * *